United States Patent [19]

Gilbert

[11] 4,183,340

[45] Jan. 15, 1980

[54] SPARK IGNITION SYSTEMS FOR INTERNAL COMBUSTION ENGINES

[75] Inventor: Brian Gilbert, Sutton Coldfield, England

[73] Assignee: Lucas Industries Limited, Birmingham, England

[21] Appl. No.: 815,039

[22] Filed: Jul. 12, 1977

[30] Foreign Application Priority Data

Jul. 24, 1976 [GB] United Kingdom ..... 30987/76

[51] Int. Cl.[2] ..... F02P 3/04

[52] U.S. Cl. ..... 123/148 DS; 123/148 E

[58] Field of Search ..... 123/148 R, 148 E, 148 DS, 123/117 R; 315/209 T

[56] References Cited

U.S. PATENT DOCUMENTS

| | | | |
|---|---|---|---|
| 3,035,108 | 5/1962 | Kaehni | 123/148 E |
| 3,242,916 | 3/1966 | Coufal | 123/148 E |
| 3,885,541 | 5/1975 | Hufton | 123/148 DS X |
| 3,919,993 | 11/1975 | Neuman | 123/148 E |
| 3,926,557 | 12/1975 | Callies et al. | 123/148 E |
| 4,112,890 | 9/1978 | Manger et al. | 123/148 E X |

FOREIGN PATENT DOCUMENTS

| | | | |
|---|---|---|---|
| 1393754 | 5/1975 | United Kingdom | 123/148 E |

*Primary Examiner*—Tony Argenbright

*Attorney, Agent, or Firm*—Ladas, Parry, Von Gehr, Goldsmith & Deschamps

[57] ABSTRACT

An internal combustion engine spark ignition system includes two inductors and a circuit for transferring energy from the inductors to a common spark circuit when current flow through the inductors is interrupted. Two transistors control current flow in the respective inductors and these are controlled by a control circuit which turns on and then off just one of the transistors when a normal spark is required, and which turns on both transistors and then turns these alternately on and off when an extended spark is required.

11 Claims, 4 Drawing Figures

SPARK IGNITION SYSTEMS FOR INTERNAL COMBUSTION ENGINES

This invention relates to spark ignition systems for internal combustion engines and has as an object to provide such a system in a convenient form.

A spark ignition system in accordance with the invention comprises a pair of inductors, means for transferring energy stored in each inductor, when current flowing therethrough is interrupted, to a common spark circuit, a pair of semiconductor switch devices associated with the inductors respectively and controlling current flow therethrough and a control circuit for said switch devices such that when a normal spark is required one of said switch devices is switched on and then off, whereas when a prolonged sparking period is required both switch devices are switched on and then repeatedly switched on and off alternately for as long as the spark is required.

Preferably, the control circuit is such that when a prolonged sparking period is required a delay is introduced between switching on said one of said switch devices and the other of said switch devices, said one of said switch devices being switched off when the sparking period is required to start and the other switch device being switched off when said one switch device is switched on again.

Figure 1:
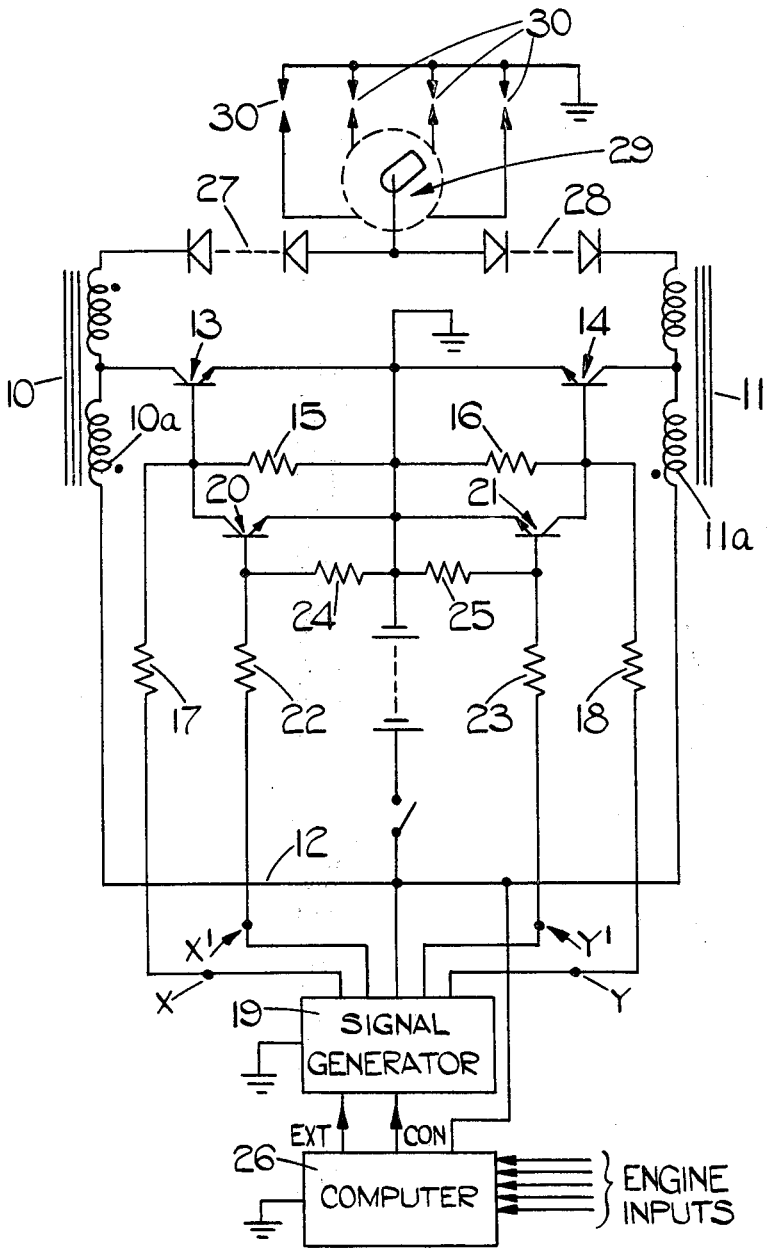
Figure 2:
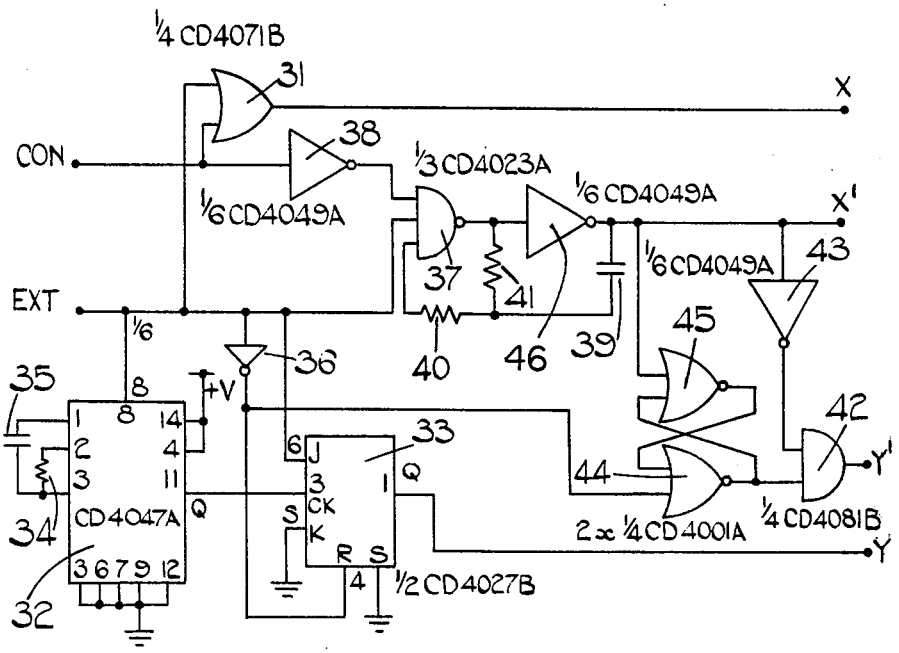

An example of the invention is shown in the accompanying drawings, in which FIG. 1 is a circuit diagram of the system, FIG. 2 is a diagram of a signal generator circuit forming part of the system and FIGS. 3 (*a*) and 3 (*b*) are graphs showing wave forms at various points in the circuit.

The system includes two conventional ignition transformers 10, 11, which have their primary windings 10*a*, 11*a*, connected between a supply rail 12 and the collectors of a pair of n-p-n power transistors 13, 14 respectively. The emitters of the transistors 13, 14 are earthed and their bases are connected by resistors 15, 16 to earth. The bases of the transistors, 13, 14 are also connected by resistors 17, 18 to output terminals X, Y of a signal generator circuit 19 for controlling the transistors.

Two further n-p-n transistors 20, 21 have their bases connected by resistors 22, 23 to terminals X' and Y' of the circuit 19. These further transistors 20 and 21 have their collectors connected to the bases of the transistors 13, 14 respectively and their emitters earthed. The bases of the transistors 20, 21 are connected by resistors 24, 25 to earth.

The signal generator 19 is controlled by a computer 26 itself having control inputs from a plurality of engine parameter transducers, such as transducers sensitive to engine speed, engine crank angle, throttle angle, manifold depression, temperature etc. The computer determines the instants at which the sparks are to be generated and also provides signals to indicate when current flow in the windings 10*a*, and 11*a* should commence and when, in certain engine conditions the sparking periods should be prolonged.

Figures 3A, 3B:
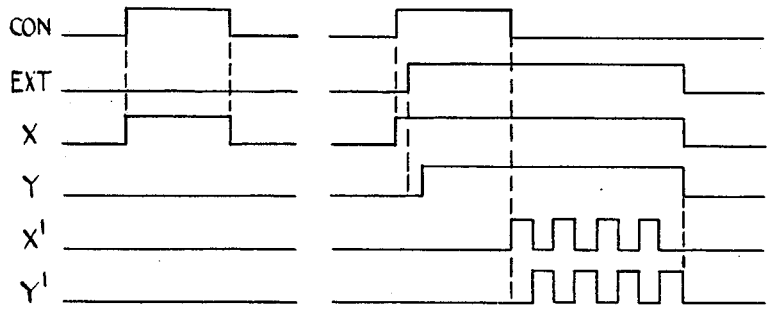

In normal operation only the transformer 10 and the transistor 13 are used. In this mode of operation the transistor 13 is switched on and off at the beginning and end respectively of each pulse at terminal X of the circuit 19. This is shown in FIG. 3*a*.

When a prolonged sparking period is required, on the other hand, both transistors 13 and 14 are switched on (but switching on of transistor 14 is delayed slightly) to enable energy to be built up in the transformers. At the instant when a spark is required, a pulse generator included in the circuit 19 switches on transistor 20 thereby switching off transistor 13. After a short interval transistor 20 is switched off again but transistor 21 is switched on. Such alternate switching on and off of the transistors 20 and 21 by pulses at the terminals X', Y' continues until the signals at the terminals X,Y terminate.

The circuit of the signal generating circuit 19 is shown in more detail in FIG. 2. The circuit has two inputs from the computer 26 marked CON and EXT. As shown in FIGS. 3(*a*) and 3(*b*) the signal at the CON terminal is normally low but goes high when coil current is required to start and reverts to low when the spark is required. At the EXT terminal, the signal is normally low but goes high, if an extended sparking period is required, shortly after the signal at the CON terminal goes high and goes low again at the end of the required extended discharge period.

The X output of the circuit 19 is derived from an OR gate 31 (e.g. ¼ of an RCA CD 4071B CMOS integrated circuit) with its two input terminals connected respectively to the CON and EXT terminals and its output terminal connected to the X terminal.

The Y output is derived from the EXT input terminal via a monostable circuit 32 (CD 4047A) with a pulse duration of about 300 uS and a flip flop 33 (½CD 4027B). The monostable circuit 32 has its input (pin 8) connected to the terminal EXT, its timing pins (1, 2, 3) interconnected by a resistor 34 and a capacitor 35, and its Q output (pin 11) connected to the CLOCK terminal of the flip-flop 33. The J input terminal of the flip-flop 33 (pin 6) is connected to the EXT terminal and the R input terminal (pin 4) is connected via an inverter 36 (1/6 CD 4049A) to the EXT terminal. The Q output terminal of the flip-flop 33 is connected to the Y terminal. These connections ensure that there is a delay between the signal on the EXT terminal going high and that on the Y terminal going high, such delay being desirable to ensure that when both transistors 13 and 14 are in use, both turn on for approximately the same duration. The inverter 36 resets the flip-flop 33 when the signal at the EXT terminal goes low.

The X' signal is derived from a CMOS oscillator gated by the signals from the CON and EXT terminals. This oscillator is constituted by a CMOS NAND gate 37 (⅓ CD 4023A) with one input terminal connected to the EXT terminal, a second input terminal connected by an inverter 38 (1/6 CD 4049A) to the CON terminal and its third input terminal connected to receive positive feedback as will become apparent. The output terminal of the NAND gate 37 is connected to the input terminal of an inverter 46 (1/6 CD 4049A) which has its output terminal connected to the X' terminal. A capacitor 39 and resistor 40 in series connect the output terminal of the inverter 46 to the third input terminal of the NAND gate 37 and a resistor 41 is connected between the output terminal of the NAND gate 37 and the junction of the capacitor 39 with the resistor 40. The resistors 40, 41 provide negative feedback around the NAND gate 37 so that it tends to operate in the linear mode when the signals at its first and second input terminals are high (i.e. when the CON signal is low and the EXT signal is high). The positive feedback via the capacitor 39 from the inverter 46 output, however, converts the arrangement into a square wave oscillator, with the X' output going high as soon as the CON input goes low whilst the EXT input remains high.

The Y' output signal is required to be the logical inverse of X' signal whenever the EXT signal is high and the oscillator 37, 46 is running. To this end, the Y' output is derived from an AND gate 42 (¼ CD 4081B), which has one input terminal connected via an inverter 43 (1/6 CD 4049A) to the X' output terminal and its other input terminal connected to the output terminal of a NOR gate 44 (¼ CD 4001A). This NOR gate 44 is cross connected with another NOR gate 45 (¼ CD 4001A) as an R-S flip-flop, with the NOR gate 45 having an input from from the inverter 46 and the NOR gate 44 having an input from the inverter 36 for setting and resetting the flip-flop formed by the NOR gates 44, 45. Thus the flip-flop 44, 45 is set by the first high at terminal X' after the EXT signal goes high, thereafter allowing gate 42 to pass the inverted X' signals until the flip-flop 44, 45 is reset by the EXT signal going low.

The secondary windings of the transformers 10, 11 are connected by diodes 27, 28 to the common terminal of the ignition distributor 29 which connects the spark plugs 30 to the ignition circuit.

It is to be understood that since the voltage required to maintain an established spark discharge is less than that required to initiate the spark, the coil 11 may be of less substantial construction than the coil 10 and the associated semiconductor components may have lesser voltage, current and/or power ratings. The mark/space ratio of the oscillator (37, 46) may be less than unity.

It is also to be understood that instead of a single prolonged spark being produced when required a series of discrete sparks may be produced. The effect of this is to prolong the sparking period.

I claim:

1. A spark ignition system for an internal combustion engine comprising a pair of inductors, means for transferring energy stored in each inductor, when current flowing therethrough is interrupted, to a common spark circuit, a pair of semiconductor switch devices associated with the inductors respectively and controlling current flow therethrough and a control circuit means for said switch devices operating when a normal spark is required to switch one of said devices on and then off and when a prolonged sparking period is required to switch both devices on before the spark is required and then repeatedly switch the switch devices on and off alternately so that whenever one device is on the other is off, for as long as the spark is required.

2. A spark ignition system for an internal combustion engine, comprising an output terminal for connection to a spark circuit, a pair of inductors, first and second semiconductor switch devices associated with the inductors respectively for controlling flow of current therethrough, means for transferring energy stored in each inductor, when current flowing therethrough is interrupted, to said output terminal, and a control circuit having output means connected to control operation of the switch devices, input means for receiving an input indicative of whether a normal spark or a prolonged sparking period is required and the instant at which the prolonged sparking period, if required, is to commence, and means connected to the input means for generating a control signal at the output means for switching the first switch device on and then off when the input at the input means indicates that a normal spark is required and, when the input at the input means indicates that a prolonged sparking period is required, generating control signals at the output means for switching both switch devices on prior to the instant at which the prolonged sparking period is to commence and, at said instant, switching one of the switch devices off and then repeatedly switching it on and off alternately for as long as the spark is required while the other switch device is repeatedly switched off and on alternatingly with said one switch device.

3. A system as claimed in claim 2, wherein each switch device has a primary control input and a secondary control input, and each switch device responds to a control signal applied to only the primary control input by switching on and responds to the absence of a control signal at the primary control input by switching off, and, in the event that a control signal is present at the primary control input, responds to a control signal applied to the secondary control input by switching off, and wherein the control signal generating means has first and second input terminals and comprises a signal generator which has four outputs connected respectively to the control inputs of the switch devices and is operative to generate a control signal only at the output connected to the primary control input of the first switch device when a signal is present at only the first input terminal and to generate control signals only at the outputs connected to the primary control inputs of the first and second switch devices when signals are present at both the first and second input terminals and, from termination of the signal at the first input terminal until termination of the signal at the second input terminal, to maintain the control signals at the outputs connected to the primary control inputs of the switch devices and to generate control signals repeatedly and alternatingly at the outputs connected to the secondary control inputs of the switch devices, whereby application of a signal to only the first input terminal indicates that a normal spark is required whereas application of signals to both the first and second input terminals indicates that a prolonged sparking period is required and that the sparking period should commence at the instant of termination of the signal applied to the first input terminal.

4. A system as claimed in claim 3, having first and second power supply terminals, and wherein each semiconductor switch device comprises a first transistor having its collector-emitter path connected in series with the associated inductor between the power supply terminals and also comprises a second transistor having its collector-emitter path connected between the base of the first transistor and one of said power supply terminals, the bases of the first and second transistors constituting the primary and secondary control inputs respectively of the switch device.

5. A system as claimed in claim 2, in which the control circuit includes delay means which responds to the input at the input means indicating that a prolonged sparking period is required by delaying generation of the control signal for switching on said other switch device with respect to the control signal for switching on said one switch device.

6. A system as claimed in claim 5, wherein the delay means is such as to delay switching on of said other switch device with respect to said one switch device by a period approximately equal to the interval between the instant at which the prolonged sparking period is to commence and the instant at which said other switch device is first switched off following commencement of the prolonged sparking period, whereby both switch devices are switched on for approximately the same duration.

7. A system as claimed in claim 2, comprising two step-up transformers each having a primary winding and a secondary winding, said primary windings providing the inductors respectively, and wherein the means for transferring energy stored in the inductors includes diode means connecting the secondary windings to said output terminal.

8. A system as claimed in claim 2, having first and second power supply terminals, and wherein each semiconductor switch device includes a transistor having its collector-emitter path connected in series with the associated inductor between the power supply terminals.

9. A system as claimed in claim 8, wherein the control circuit includes a signal generator circuit connected to provide base current to the transistors when conduction of the latter is required.

10. A system as claimed in claim 9 including a pair of further transistors controlled by the signal generator circuit and arranged to divert the base current from the first mentioned transistors when the latter are turned on and off alternately.

11. A system as claimed in claim 10 in which said signal generator circuit includes logic circuits controlling the supply of base current to the first mentioned transistors, a gated oscillator arranged to oscillate when alternate switching on and off of the first-mentioned transistors is required, said oscillator being connected to the base of the one of said further transistors associated with said one of the first mentioned transistors which is switched on and off when a normal spark is required, and a logic circuit providing a logical inversion of the oscillator output and connected to the other one of said further transistors.

* * * * *